US008068751B2

(12) United States Patent
Yamazaki

(10) Patent No.: US 8,068,751 B2
(45) Date of Patent: Nov. 29, 2011

(54) IMAGE FORMING APPARATUS

(75) Inventor: Katsuyuki Yamazaki, Toride (JP)

(73) Assignee: Canon Kabushiki Kaisha (JP)

( * ) Notice: Subject to any disclaimer, the term of this patent is extended or adjusted under 35 U.S.C. 154(b) by 182 days.

(21) Appl. No.: 12/613,318

(22) Filed: Nov. 5, 2009

(65) Prior Publication Data

US 2010/0111567 A1 May 6, 2010

(30) Foreign Application Priority Data

Nov. 5, 2008 (JP) ..... 2008-284258
Nov. 2, 2009 (JP) ..... 2009-251795

(51) Int. Cl.
*G03G 15/043* (2006.01)
*G03G 15/00* (2006.01)

(52) U.S. Cl. ..... 399/51; 399/66; 399/167

(58) Field of Classification Search ..... 347/122, 347/129, 132, 225, 229, 246, 248; 399/47, 399/50, 51, 66, 167
See application file for complete search history.

(56) References Cited

U.S. PATENT DOCUMENTS 6,795,099 B2 9/2004 Koga et al.
7,512,349 B2 3/2009 Itoh et al.
2007/0160376 A1 7/2007 Ishida et al.

FOREIGN PATENT DOCUMENTS

JP 63-049779 A 3/1988
JP 2004-223716 A 8/2004
JP 2006-171595 A 6/2006
JP 2007-034233 A 2/2007
JP 2007-187829 A 7/2007

*Primary Examiner* — Mark R Gaworecki
(74) *Attorney, Agent, or Firm* — Rossi, Kimms & McDowell LLP

(57) ABSTRACT

An image forming apparatus that can improve image quality by correcting for variations in the potential characteristics of a photosensitive member and enhance the responsiveness of an image forming operation. The photosensitive member is rotated by a drive unit and exposed to light from an exposure unit. A first generation unit periodically generates a first signal. A second generation unit generates a second signal. A plurality of generation periods of the second signals are included in one generation period of the first signal. A control unit, while the photosensitive member is controlled to accelerate, counts the second signals in response to input of the first signal, identifies an exposure position when the photosensitive member is switched from the acceleration control to constant-speed control, reads correction data corresponding to the identified exposure position from a storage unit, and controls the light quantity of the exposure unit.

5 Claims, 11 Drawing Sheets

IMAGE FORMING APPARATUS

BACKGROUND OF THE INVENTION

1. Field of the Invention

The present invention relates to an image forming apparatus that scans light irradiated on a photosensitive member while rotating the photosensitive member, thereby forming an image on the photosensitive member.

2. Description of the Related Art

In recent years, electrophotographic printers have been increasing in performance, and techniques for realizing improvements in responsiveness in printing, print speed, and print image quality, and low cost.

Examples of indexes for evaluating the responsiveness include FPOT (First Print Out Time) and FCOT (First Copy Out Time) as the time period between user's print instruction and the completion of output a first recording medium with an image formed thereon. FPOT and FCOT are desired to be a few seconds or less.

By the way, a thickness of a photosensitive layer (hereinafter referred to as the "film thickness") of a photosensitive drum in electrophotographic printers cannot be uniform due to the limits of production accuracy. Moreover, a surface of the photosensitive drum wears because the photosensitive drum comes into contact with a recording medium, an intermediate transfer member, or a cleaning member during the formation of an image. At this time, the wear amount differs at individual positions of the photosensitive drum, and hence the unevenness of the film thickness is further promoted. In a case where such a photosensitive drum is charged and exposed to light, potential characteristics of the surface of the photosensitive drum cannot be uniform. For this reason, there are variations in an image density of an output image. Therefore, to correct for variations in the image density of an output image resulting from nonuniform potential characteristics of the surface of the photosensitive drum and improve image quality, a technique to correct for variations in the potential characteristics of the surface of the photosensitive drum has been developed. As examples of such a technique, those disclosed in Japanese Laid-Open Patent Publication (Kokai) No. S63-49779, Japanese Laid-Open Patent Publication (Kokai) No. 2004-223716, Japanese Laid-Open Patent Publication (Kokai) No. 2007-187829, and Japanese Laid-Open Patent Publication (Kokai) No. 2007-34233 are known. These prior arts are a technique to correct for variations in the potential characteristics of the photosensitive drum by adjusting a laser light exposure amount according to a position exposed to light when an exposure unit exposes the photosensitive drum to light. This technique have realized an improvement in print quality, resulting in an improvement in allowable variation level, and a decrease in the production cost of the photosensitive drum which is highly-durable and long-lived and allows variations in the potential characteristics.

FIG. 6 is a diagram schematically showing an arrangement of an optical writing unit in an image forming apparatus that corrects for variations in the potential characteristics of the surface of a photosensitive drum. The image forming apparatus is a one-photosensitive drum four-beam laser simultaneous scanning electrophotographic printer. For the simplification of explanation, units for forming an image on a paper medium, such as a charging unit, a developing unit, a transfer unit, and a fixing unit associated with a general electrophotographic process are omitted from the figure.

The image forming apparatus has a multi-beam laser optical writing unit 1100, a system control unit 1140, an image data process unit 1150, a photosensitive drum 1130, and so on. The system control unit 1140 controls the overall operation of the apparatus, and is comprised of a CPU, a ROM, a RAM, a user interface (not shown) for controlling devices, and so on.

The image data process unit 1150 is comprised of an ASIC, and operates while communicating information with the system control unit 1140 by register access from the CPU of the system control unit 1140. A drum drive unit 1136 that drives the photosensitive drum 1130 to rotate is provided on a side of the photosensitive drum 1130.

FIG. 7 is a timing chart showing operations of the units when the photosensitive drum starts rotating in the image forming apparatus. The timing chart shows a photosensitive drum drive state 1201, a photosensitive drum potential characteristic variation correcting process valid/invalid state 1202, and a rotation reference position signal 1122. The rotation reference position signal 1122 is obtained by a rotation reference position sensor 1120 and a rotation position mark 1121. States a to e in the figure correspond to determinations about control states by the system control unit 1140 and state transitions responsive to control instructions.

FIGS. 8A and 82 are flowcharts showing procedures of an image forming operation and procedures of a potential characteristic variation correcting operation. In the figure, FIG. 8A shows the operation of the CPU in the system control unit 1140, and FIG. 8B shows the operation of a potential characteristic correction unit 1161 in the image data process unit 1150 (ASIC). In the figure, broken lines indicate transmission of information via input/output signals to and from the devices.

Referring to FIGS. 6, 7, 8A, and 8B, a description will be given of the operation of the image forming apparatus. The system control unit 1140 brings the image forming apparatus into an image formation stopped-and-drum stopped state as an initial state (step S101). This state is represented by the drive state a in FIG. 7. On the other hand, the potential characteristic correction unit 1161 lies in a state of not corrected for variations as an initial state. Namely, the potential characteristic correction unit 1161 is waiting in the variation correcting process invalid state d in FIG. 7.

The system control unit 1140 waits for an instruction to start image formation (step S102). Upon receiving the instruction to start image formation, the system control unit 1140 instructs the drum motor drive unit 1136 and a polygon mirror motor drive unit 1103*a* to start operating, thus starting a preparation for image formation (step S103). In the preparation for image formation, the drum drive unit 1136 starts driving the photosensitive drum 130 according to a rotation instruction signal 1141 given to the drum drive unit 1136. At the same time, the polygon mirror motor drive unit 1103*a* starts rotating a polygon mirror 1103 at constant speed according to a rotation instruction signal 1142 for scanning laser light. At this time, the drive state 1201 of the photosensitive drum 1130 is the drive state b.

The system control unit 1140 waits until a predetermined waiting time period has elapsed after the start of the motors (step S104). When the predetermined waiting time period has elapsed, the drive state 1201 of the photosensitive drum 1130 changes to the drive state c in which the photosensitive drum 1130 rotates at stable constant speed required for image formation.

The system control unit 1140 confirms an input of the rotation reference position signal (drum reference signal) 1122 (step S105). In the drive state b in which the photosensitive drum 1130 starts rotating and the drive state c, the rotation reference position signal 1122 is generated each time the rotation position mark 1121 on the photosensitive drum 1130 passes the rotation reference position sensor 1120 of the photosensitive drum 1130.

After the drive state 1201 of the photosensitive drum 1130 changes to the drive state c in which the photosensitive drum 130 rotates at stable speed, the rotation speed of the polygon mirror 1103 stabilizes, and further, at the time when the rotation reference position signal 1122 is inputted, the system control unit 1140 instructs to correct for variations in potential characteristics (step S106). As a result, a register access instruction 1143 for the correction for variations in potential characteristics is generated, and the variation correcting process valid/invalid state 1202 changes to the valid state e.

The system control unit 1140 carries out the image forming operation (step S107). During the image forming operation, the image data process unit 1150 starts image data process in response to the register access instruction 1143 for image formation from the system control unit 1140.

When image data 1151 is inputted from an external personal computer (not shown), the image data 1151 is sent to a line buffer control unit 1152 and stored as data in line buffers 1153 corresponding in number to the number of multiple lasers. The stored data is read in parallel as data corresponding in number to the number of multiple lasers from the line buffers 1153 in timing with BD signals 1135, and sent to a photosensitive drum potential characteristic correction image process unit (multiplication unit) 1154.

Next, a description will be given of a flow of a photosensitive drum potential characteristic variation correction image process. After the photosensitive drum 1103 goes into the drive state c in which it rotates at stable speed, the potential characteristic correction unit 1161 carries out an address computation at the time when the rotation reference position signal 1122 is inputted (step S201). The address computation is carried out based on the BD signal 1135 indicative of a scanning start position generated by laser light incident on a laser light sensor for controlling a beam exposure start position in laser scanning, and counting using crystal oscillator clocks. As a result of the address computation, an appropriate address for taking out variation correction data is selected.

The potential characteristic correction unit (memory controller) 1161 selects and successively reads correction data from a nonvolatile memory (table memory) 1160 storing table data on variations in photosensitive drum potential characteristics (correction data) (step S202). The correction data is prepared in advance in the table memory 1160 in accordance with a photosensitive drum provided in the image forming apparatus.

The potential characteristic correction unit 1161 causes matching process units 1163 to successively carry out processes for matching the table data on variations in photosensitive drum potential characteristics transmitted via memory data buses 1162 to data that is to be multiplied with image data (step S203). Further, the potential characteristic correction unit 1161 successively transmits the variation correction data from the matching process unit 1163 to the multiplication unit 1154 (step S204). The multiplication unit 1154 multiplies the image data with the variation correction data. After that, the potential characteristic correction unit 1161 terminates the present operation.

In the above described way, after the drive state 1201 of the photosensitive drum 1103 goes into the drive state c in which it rotates at stable speed, at the time when the rotation reference position signal 1122 is inputted, an appropriate address for taking out variation correction data is selected based on the BD signal 1135 indicative of a scanning start position and counting using the crystal oscillator clocks. Thereafter, the potential characteristic correction unit 1161 goes into a state of correcting for variations in potential characteristics, and the variation correction process valid/invalid state 1202 goes into the valid state e.

The data having been subjected to the potential characteristic variation correcting process by a computation (multiplication) of the data from the line buffers 1153 and the variation correction data in the multiplication unit 1154 is transmitted to a laser Pulse Width Modulation Unit (PWMU) 1155, and made available for use in blinking a four-beam multi-laser semiconductor chip 1101 via a laser current drive unit 1106.

The laser light is gathered by a collimator lens 102 and then reflected/scanned by the polygon mirror 1103 to pass through an fθ lens 104. Further, the laser light follows a laser light path 1105 from the polygon mirror 1103 to the photosensitive drum 1130 and is scanned on the photosensitive drum 1130 along paths taken by scanning lines 1133 of exposure spots 1131 by the four-beam multi laser by rotation of the polygon mirror 1103. On the photosensitive drum 1130 thus charged, an electrostatic latent image is formed.

After the electrostatic latent image is formed, the image forming apparatus develops the electrostatic latent image with toner, transfers the image to a paper medium, fixes the image on the paper medium by heating and pressurizing, so that an image is formed.

When a time period required to form an image of a predetermined size has elapsed, the system control unit 1140 determines whether or not the image forming operation has been completed (step S108). When the image forming operation has been completed, the system control unit 1140 outputs the rotation instruction signal 1141 to stop the rotation of the photosensitive drum 1103 (step S109), and waits until the stop of the photosensitive drum 1130 is confirmed (step S110). Upon confirming the stop, that is, the completion of the deceleration, the system control unit 1140 terminates the present operation.

By carrying out the above described operation, the image forming apparatus draws a latent image on which the correction for variations in the potential characteristics of the photosensitive drum has been carried out, and the correction for variations in laser writing has been carried out.

However, there are problems as described below in improving the performance of the conventional image forming apparatus. When acceleration control for accelerating the photosensitive member is switched to constant-speed control, the formation of an image may not be started immediately depending on the position of the rotation position mark 1121 provided on the photosensitive drum relative to the rotation reference position sensor 1120. The correction for variations in the potential characteristics of the photosensitive drum is started in response to generation of the rotation reference position signal (drum reference signal) 1122. The rotation reference position signal 1122 is generated in response to the rotation position mark 1121 provided on the photosensitive drum passing the rotation reference position sensor 1120, but the formation of an image cannot be started unless the rotation reference position signal 1122 is generated even when the formation of an image is ready to be started in a state in which the photosensitive drum is rotating at constant speed. For this reason, there may be a case where the formation of an image cannot be started until substantially one turn of the photosensitive drum is completed after the rotation speed comes to be a constant speed, and in this case, FPOT lowers.

For example, if the photosensitive drum of 80 mmϕ is rotated at a surface speed of 251 mm/sec, the time period required for one turn of the photosensitive drum is as follows.

80*3.14/251−251 mm/251=1 sec

In a case where the acceleration control of the photosensitive drum is completed and switches to the constant-speed control immediately after the rotation position mark 1121 passes the rotation reference position sensor 1120, the formation of an image cannot be started until the rotation position mark 1121 passes the rotation reference position sensor 1120 next time. Namely, the output of an image delays about one second at the maximum, and this causes considerable deterioration of performance for printers assuming correction.

Here, if the time period required for stabilization of the rotation speed of the polygon mirror is longer than the time period required for stabilization of the rotation speed of the photosensitive drum, the formation of an image cannot be started until the rotation speed of the polygon mirror stabilizes, and hence the above described problem is alleviated or does not arise. However, because polygon mirrors of recent years have been increasingly reduced in weight, and the rotation speed of the polygon mirror stabilizes within a short time period than the time period required for stabilization of the rotation speed of the photosensitive drum. For this reason, in response to stabilization of the rotation speed of the photosensitive drum, image forming apparatuses of recent years go into a state of readiness to carry out image formation. Thus, the above described problem may arise.

SUMMARY OF THE INVENTION

The present invention provides an image forming apparatus that can correct for variations in potential characteristics of a photosensitive member, thus improving image quality and enhancing the responsiveness of an image forming operation.

Accordingly, in a first aspect of the present invention, there is provided an image forming apparatus comprising a photosensitive member, a drive unit configured to rotate said photosensitive member by a drive motor, an exposure unit configured to emit a light for exposing said photosensitive member, a storage unit configured to store correction data for correcting a light quantity of said exposure unit in association with exposure positions on said photosensitive member, a first generation unit configured to generate a first signal in response to a reference position provided on said photosensitive member passing a predetermined position while said photosensitive member is rotating, a second generation unit configured to generate a second signal in accordance with rotation of said photosensitive member, a plurality of generation periods of the second signals being included in one generation period of the first signal, and a control unit configured to, while during an acceleration control in which said photosensitive member is controlled to accelerate by said drive unit, count the second signals in response to input of the first signal, identify based on a count value of the second signals an exposure position when said photosensitive member is switched from the acceleration control to a constant-speed control in which said photosensitive member is controlled to maintain a constant speed by said drive unit, read correction data corresponding to the identified exposure position from said storage unit, and control the light quantity of said exposure unit based on the correction data read from said storage unit.

According to the first aspect of the present invention, while the photosensitive member is controlled to accelerate by the drive unit, the second signals are counted in response to input of the first signal, the exposure position when the photosensitive member is switched from the acceleration control to constant-speed control is identified based on a count value of the second signals, correction data corresponding to the identified exposure position is read from the storage unit, and the light quantity of the exposure unit is controlled based on the correction data read from the storage unit. As a result, variations in the potential characteristics of the photosensitive member can be corrected for, which improves image quality and enhances the responsiveness of an image forming operation.

Further features of the present invention will become apparent from the following description of exemplary embodiments (with reference to the attached drawings).

DESCRIPTION OF THE EMBODIMENTS

The present invention will now be described in detail with reference to the drawings showing embodiments thereof.

Figure 1:
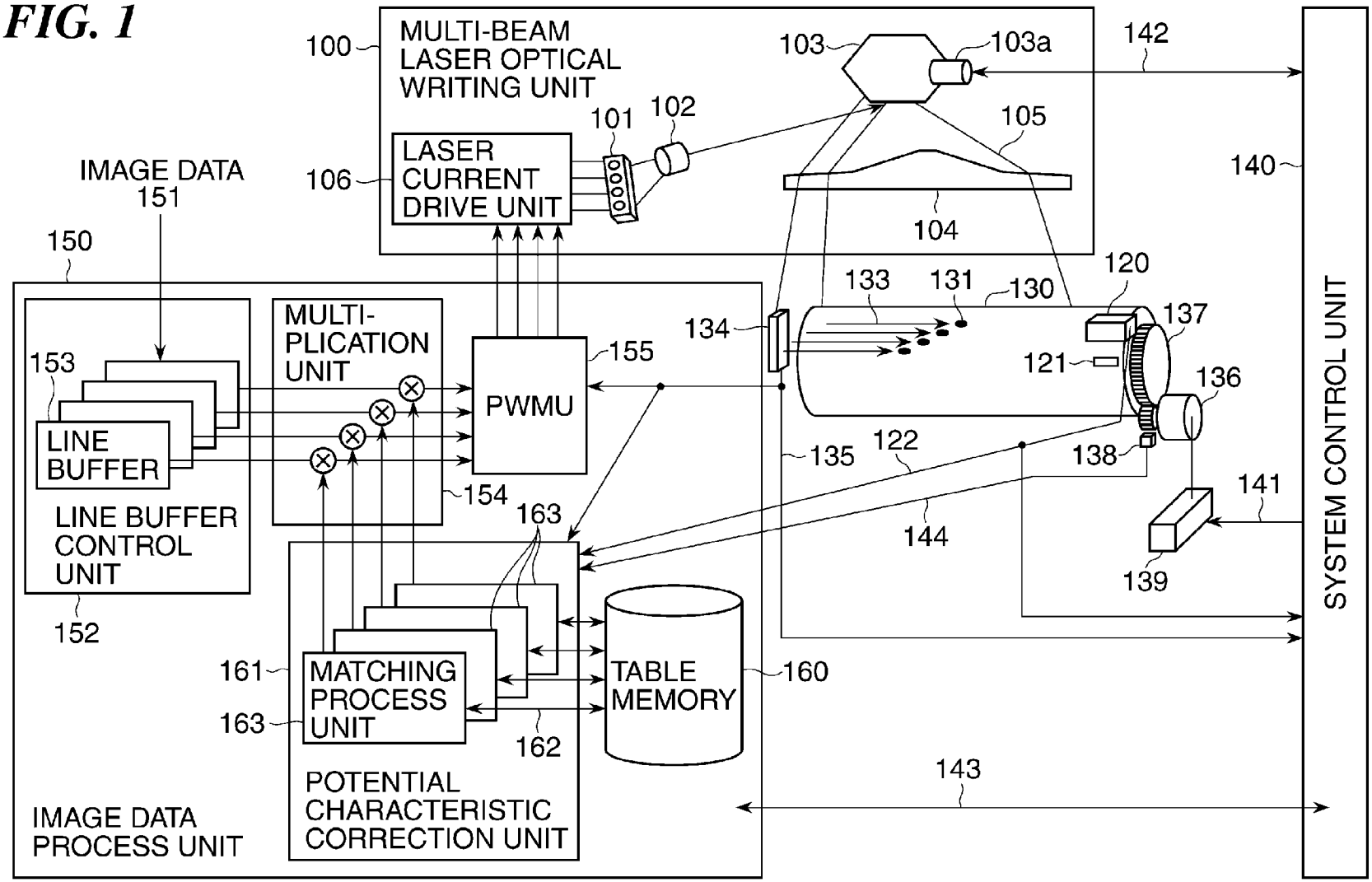
FIG. 1 is a diagram schematically showing an arrangement of an optical writing unit in an image forming apparatus according to a first embodiment of the present invention.

FIG. 1 is a diagram schematically showing an arrangement of an optical writing unit in an image forming apparatus according to a first embodiment of the present invention. The image forming apparatus is a one-photosensitive drum four-beam laser simultaneous scanning electrophotographic printer. For the simplification of explanation, units for forming an image on a paper medium, such as a charging unit, a developing unit, a transfer unit, and a fixing unit associated with a general electrophotographic process are omitted from the figure.

The image forming apparatus has a multi-beam laser optical writing unit 100, a system control unit 140, an image data process unit 150, a photosensitive drum 130, and so on.

The system control unit 140 controls the overall operation of the apparatus, and is comprised of a CPU, a ROM, a RAM, a user interface (not shown) for controlling devices, and so on. The image data process unit 150 is comprised of an ASIC, and operates while communicating information with the system control unit 140 by register access from the CPU of the system control unit 140.

The multi-beam laser optical writing unit 100 (exposure unit) irradiates laser light onto a surface of the photosensitive drum 130 to form a latent image thereon. The multi-beam laser optical writing unit 100 has a four-beam multi-laser semiconductor chip 101, a collimator lens 102, a polygon mirror 103, an fθ lens 104, a laser current drive unit 106, and a polygon mirror motor driving unit (polygon motor) 103*a*. The polygon mirror motor driving unit 103*a* drives the polygon mirror 103 that scans laser light.

The image data process unit 150 has a line buffer control unit 152, a photosensitive drum potential characteristic correction image process unit (multiplication unit) 154, a laser PWMU 155, a nonvolatile memory (table memory) 160, and a potential characteristic correction unit (memory controller) 161. The line buffer control unit 152 has line buffers 153 to which image data is inputted.

The table memory 160 (storage unit) holds table data (correction data) on variations in the potential characteristics of a photosensitive drum provided in the image forming apparatus, and the table data is prepared in advance in accordance with a photosensitive drum provided in the image forming apparatus. The potential characteristic correction unit (control unit) 161 has matching process units 163 for matching the correction data stored in the table memory 160 with data that is to be multiplied with image data. Also, the potential characteristic correction unit 161 has a counter memory (not shown), a hardware counter (not shown) that counts clocks (reference clocks) of a crystal oscillator (clock generation unit), a gear counter (not shown) that counts output signals (gear photo-sensor output signals 144 (first signals)) from a gear photo-sensor 138, described later, and so on.

Also, the image forming apparatus has a DC brushless motor 136 and a driving unit 139 (driving unit) that rotate the photosensitive drum 130. The DC brushless motor 136 has a reduction gear 137 (gear member) that transmits motor power to the photosensitive drum 130, a small gear mark (not shown), and the gear photo-sensor 138 (first generation unit) that reads the mark. A BD sensor 134 that generates a BD signal 135 indicative of a scanning start position is provided on a side of the photosensitive drum 130. Around the axial circumference of the photosensitive drum 130, there is provided a rotation reference position sensor 120 (second generation unit) that reads a rotation position mark 121 provided on a side of the photosensitive drum 130 and outputs a rotation reference position signal 122 (second signal).

Figure 2:
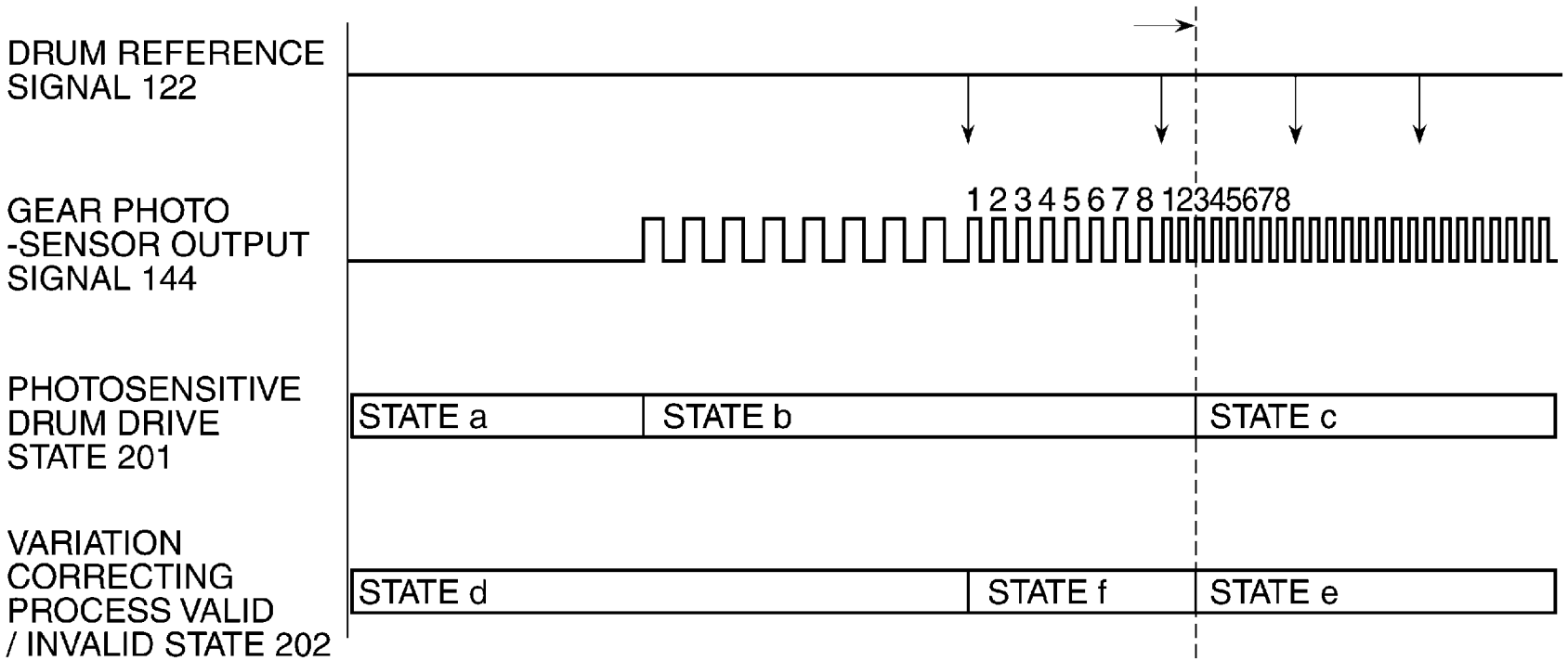
FIG. 2 is a timing chart showing operations of units when a photosensitive drum starts rotating in the image forming apparatus.

FIG. 2 is a timing chart showing operations of the units when the photosensitive drum 130 starts rotating in the image forming apparatus. The timing chart shows a photosensitive drum drive state 201, a variation correcting process valid/invalid state 202 for the photosensitive drum 130, the gear photo-sensor output signal 144, and the rotation reference position signal 122. The rotation reference position signal 122 is obtained by the rotation reference position sensor 120 and the rotation position mark 121. States a to f in the figure correspond to determinations about control states by the system control unit 140 and state transitions responsive to control instructions.

Figure 3A:
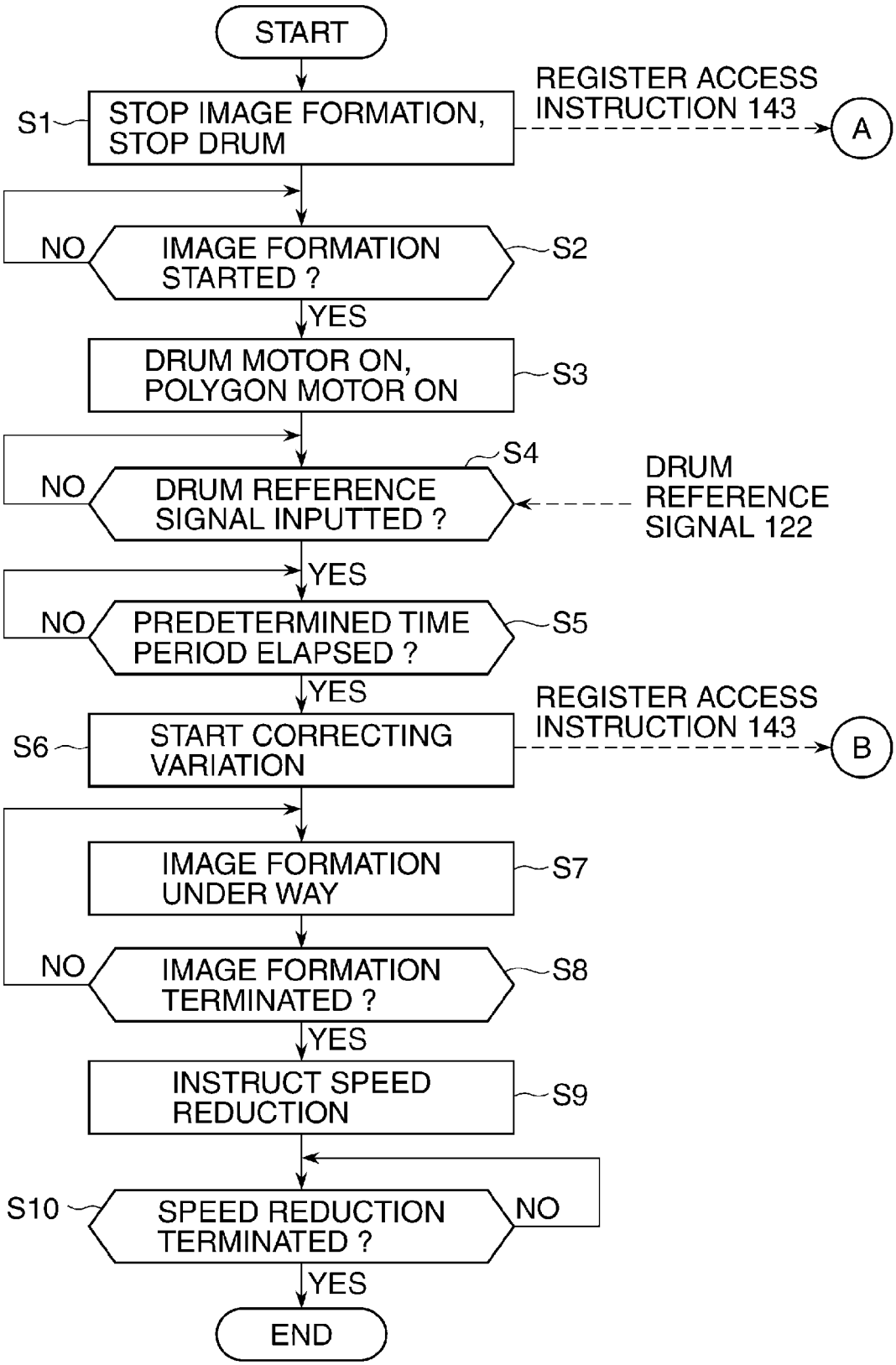
FIGS. 3A and 3B are flowcharts showing procedures of an image forming operation and procedures of a potential characteristic variation correcting operation.
Figure 3B:
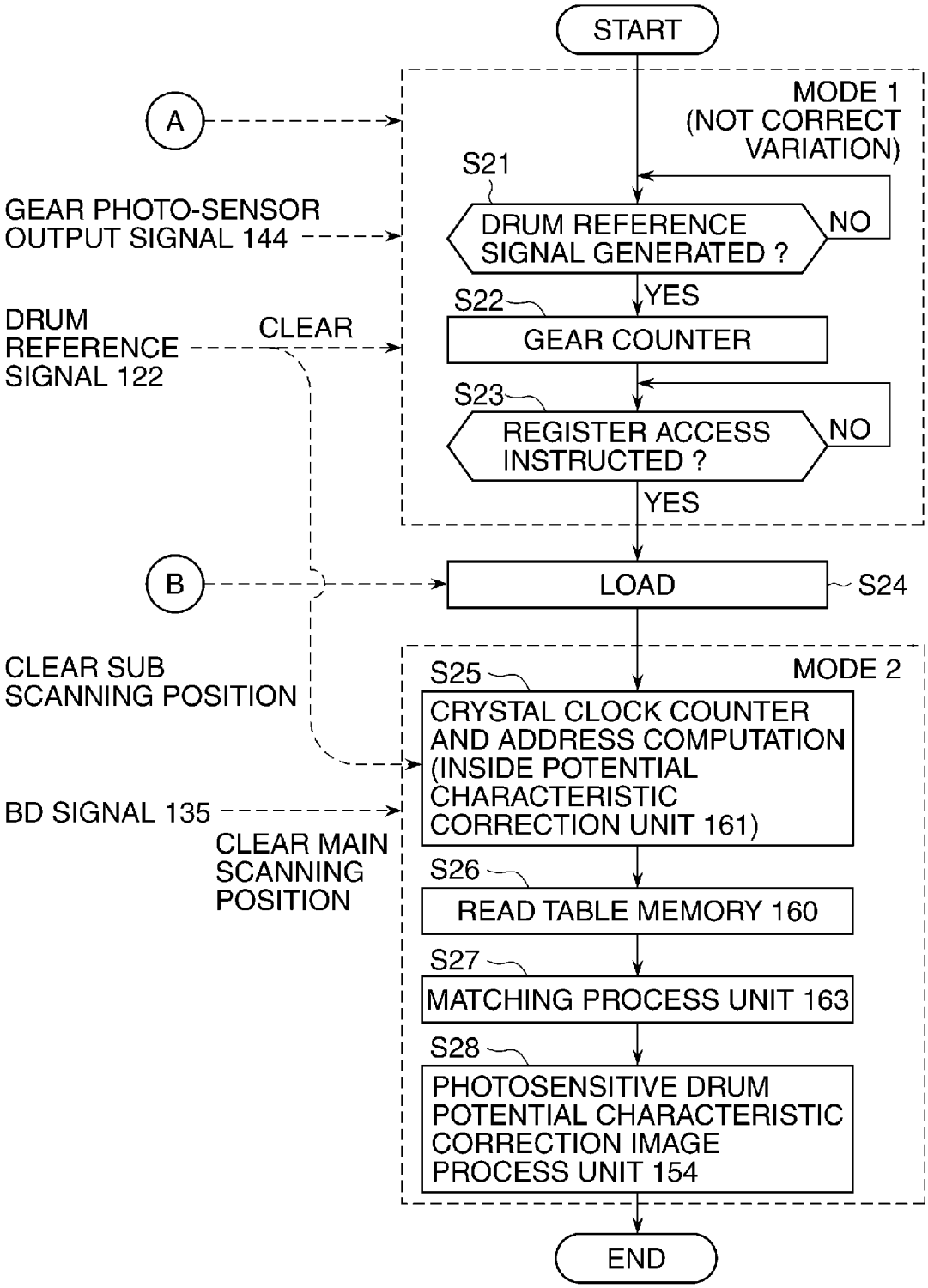

FIGS. 3A and 3B are flowcharts showing procedures of an image forming operation and procedures of a potential characteristic variation correcting operation. In the figure, FIG. 3A shows the operation of the CPU in the system control unit 140, and FIG. 3B shows the operation of the potential characteristic correction unit 161 in the image data process unit 150 (ASIC). In the figure, broken lines indicate the transmission of information via input/output signals to and from the devices.

Referring to FIGS. 1, 2, and 3, a description will be given of the operation of the image forming apparatus. The system control unit 140 brings the image forming apparatus into an image formation stopped-and-drum stopped state as an initial state (step S1). This state is represented as the drive state a in FIG. 2. Also, the potential characteristic correction unit 161 lies in a state of not correcting for variations as an initial state. Namely, the potential characteristic correction unit 161 is waiting in the variation correcting process invalid state d (see FIG. 2).

The system control unit 140 waits for an instruction to start image formation (step S2). Upon receiving the instruction to start image formation, the system control unit 140 instructs the DC brushless motor (drum motor) 136 and the polygon mirror motor drive unit 103*a* to start operating, thus starting a preparation for image formation (step S3). In the preparation for image formation, the drive unit 139 drives the DC brushless motor 136 to start driving the photosensitive drum 130 according to a rotation instruction signal 141 given to the drive unit 139. At the same time, the polygon mirror motor drive unit 103*a* starts rotating the polygon mirror 103 at constant speed according to a rotation instruction signal 142 given to the polygon mirror motor drive unit 103*a*. The drive state 201 of the photosensitive drum 130 at this time is the drive state b (see FIG. 2).

The system control unit 140 waits until it confirms the inputting of the rotation reference position signal (drum reference signal) 122 (step S4). Upon recognizing the inputting of the rotation reference position signal 122, the system control unit 140 waits until a predetermined waiting time period has elapsed after the start of the motors (step S5). When the predetermined waiting time period has elapsed, the drive state 201 of the photosensitive drum 130 changes to the drive state c in which the photosensitive drum 130 rotates at a stable constant speed required for image formation.

In the drive state b in which the photosensitive drum 130 starts rotating and the drive state c, the rotation reference position signal 122 is generated each time the rotation position mark 121 on the photosensitive drum 130 passes the rotation reference position sensor 120 of the photosensitive drum 130. The rotation of the photosensitive drum 130 is detected by the gear photo-sensor 138 reading the small gear mark (not shown) of the reduction gear 137.

In the drive state b in which the photosensitive drum 130 starts rotating and the drive state c, a gear photo-sensor output signal 144 is periodically generated. The gear photo-sensor output signal 144 is generated according to the reduction ratio to the photosensitive drum 130 and the gear mark interval, and in the present embodiment, the reduction gear 137 and the gear photo-sensor 138 are configured at such a ratio that the gear photo-sensor output signals 144 is generated 400 times per one turn of the photosensitive drum 130. Here, because the photosensitive drum 130 has a drum diameter of 80 mmϕ, one turn of the photosensitive drum 130 is about 251 mm. The interval between the gear photo-sensor output signals 144 is equivalent to about 251/400=0.26 mm.

It should be noted that the gear photo-sensor output signal 144 and the rotation reference position signal 122 from the rotation reference position sensor 120 of the photosensitive drum 130 do not always make a transition at the same time due to mechanical errors (mechanical variations) of the image forming apparatus according to the present embodiment. However, due to mechanical accuracy, the reduction ratio and the drum circumference are determined so that variations in the number of output signals from the gear photo sensor 138 counted (cumulatively counted) between the rotation reference position signals 122 indicative of the rotation reference position of the photosensitive drum 130 can be controlled to one count or less.

Moreover, in the states a and b in FIG. 2, the photosensitive drum potential characteristic correction image process unit (multiplication unit) 154 lies in a first mode (mode 1) due to a register access instruction from the system control unit 140. The first mode is a mode in which the present rotation position of the photosensitive drum 130 is detected and continuously updated by counting (cumulatively counting) the gear photo-sensor output signals 144 using the gear counter based on the rotation reference position signal 122 from the rotation reference position sensor 120 of the photosensitive drum 130. The gear counter, which is provided in the potential characteristic correction unit 161 as described above, starts counting the number of pulses of the gear photo-sensor output signals 144 after the value is cleared (initialized) by the output signal (rotation reference position signal) 122 from the rotation reference position sensor 120.

On the other hand, the potential characteristic correction unit 161 waits until the first the rotation reference position signal 122 is generated (step S21). When the first rotation reference position signal 122 is generated, the variation correcting process state 202 of the potential characteristic correction unit 161 changes to the state f in FIG. 2, and rotation positions (sub scanning positions in the rotational direction) are detected from combinations of the rotation reference position signals 122 and the gear photo-sensor output signals 144 (step S22). The process in the step S22 corresponds to a sub scanning position detection unit.

It should be noted that, to explain the functions of the present embodiment in an easily understood manner, a waveform of the gear photo-sensor output signal 144 in the state f and the subsequent state is expressed such that the gear photo-sensor output signal 144 is outputted eight times per one turn of the photosensitive drum 130.

The image forming apparatus according to the present embodiment is configured such that the first mode is a variation non-correcting mode in which variations in potential characteristics are not corrected for. Moreover, when the rotation speed of the polygon mirror 103 stabilizes, then the drive state 201 of the photosensitive drum 130 changes to the drive state c in which the photosensitive drum 130 rotates at stable speed.

As described above, the system control unit 140 waits for input of the first rotation reference position signal 122 in the step S4 after driving the drum motor and the polygon mirror motor. After the elapse of a predetermined time period since the output of the rotation instruction signal as a drum driving instruction in the step S5 (after the end of a change in rotation speed), the system control unit 140 instructs to correct for variations in potential characteristics in response to a register access instruction 143 for mode switching (step S6).

On the other hand, the potential characteristic correction unit 161 waits for a register access instruction 143 for mode switching (step S23), and upon receiving this register access instruction 143, the potential characteristic correction unit 161 switches into a second mode. The second mode is a mode in which an appropriate address for taking out variation correction data is selected, and an exposure amount is controlled based on correction data corresponding to the address so that the potential characteristic correction unit 161 can correct for variations in potential characteristics. The appropriate address corresponds to an exposure position, on the photosensitive drum, by the laser emitted from the multi-beam laser optical writing unit 100. The variation correcting process state 202 in FIG. 2 changes to the valid state e.

At the time of the mode switching, the function of transferring information on a position on the photosensitive drum 130, which is a characteristic of the present embodiment, is performed. Specifically, the potential characteristic correction unit 161 converts information on a position on the photosensitive drum 130, which has been detected in the first mode (mode 1), into a rotation reference position signal-based time period, and loads the conversion result as an initial counter value of the second mode (mode 2) (step S24). The process in the step S24 corresponds to a position obtaining unit.

In the example in FIG. 2, at the time when the variation correcting process state 202 goes into the state e, the cumulative count value of the gear photo-sensor output signal 144 is 3. Here, because one count of the gear photo-sensor corresponds to about 31 mm (≈125 msec) which is 251 mm/8 times, and thus corresponds to a count of 1250 by a 10 MHz crystal oscillator clock counter. Thus, the cumulative count value 3 corresponds to 94.1 mm (≈375 msec=a count of 3750).

At the time of switching from the mode 1 to the mode 2, the potential characteristic correction unit 161 loads the count of "3750" as an initial counter value of a clock counter for the mode 2, and starts operation in the mode 2.

In the mode 2, the potential characteristic correction unit 161 computes an appropriate address based on the BD signal 135 and counting by a hardware counter using crystal oscillator clocks (reference clocks) with reference to the rotation reference position sensor output signal 122 (step S25). Specifically, with reference to the rotation reference position sensor output signal 122, counting by the hardware counter is cleared and restarted. Then, according to the computed address, data for use in correcting for variations in potential characteristics in the sub scanning direction which is the rotational direction of the photosensitive drum 130 and the main scanning direction vertical to the sub scanning direction is obtained.

Figure 8A:
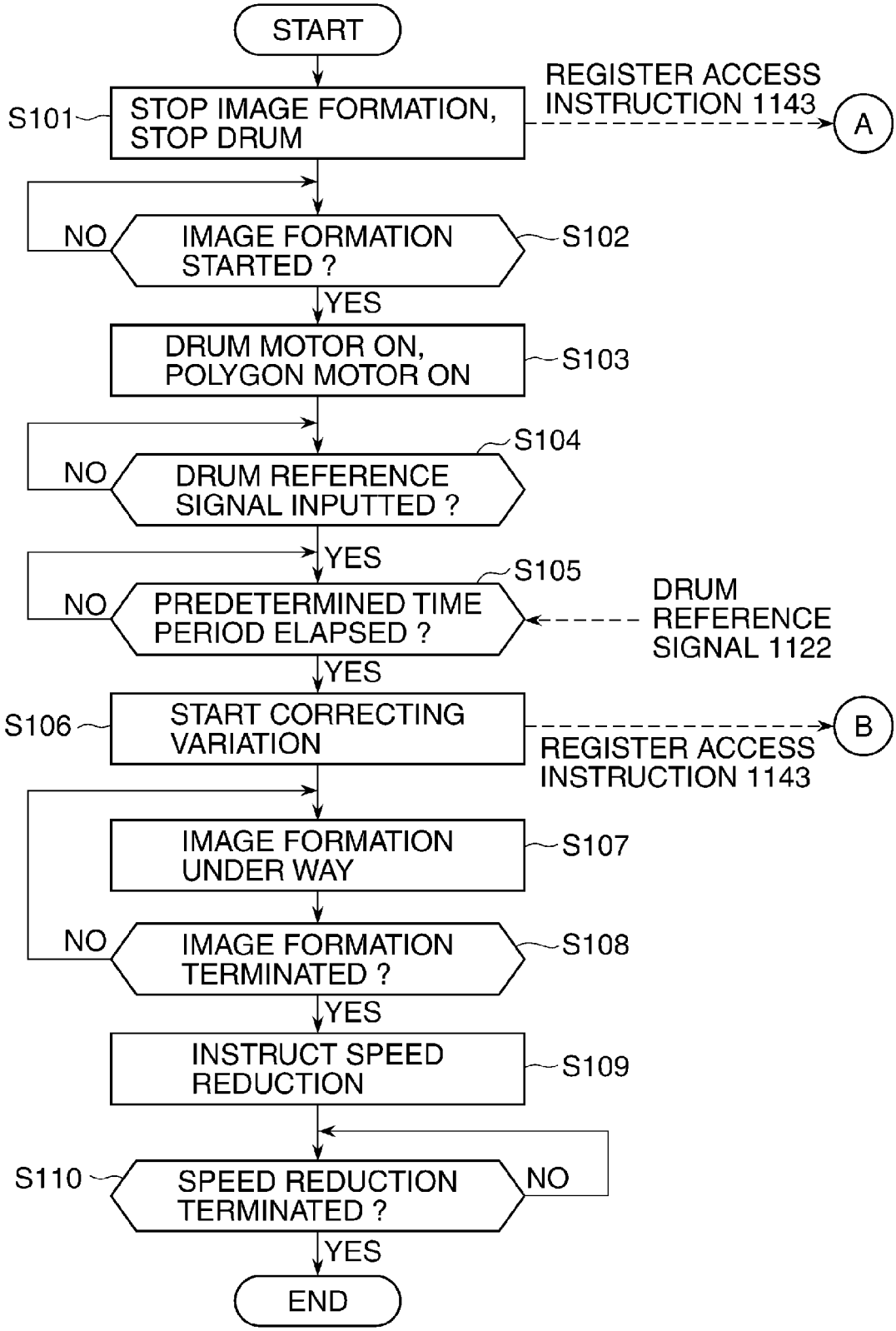
FIGS. 8A and 8B are flowcharts showing procedures of an image forming operation and procedures of a potential characteristic variation correcting operation.
Figure 8B:
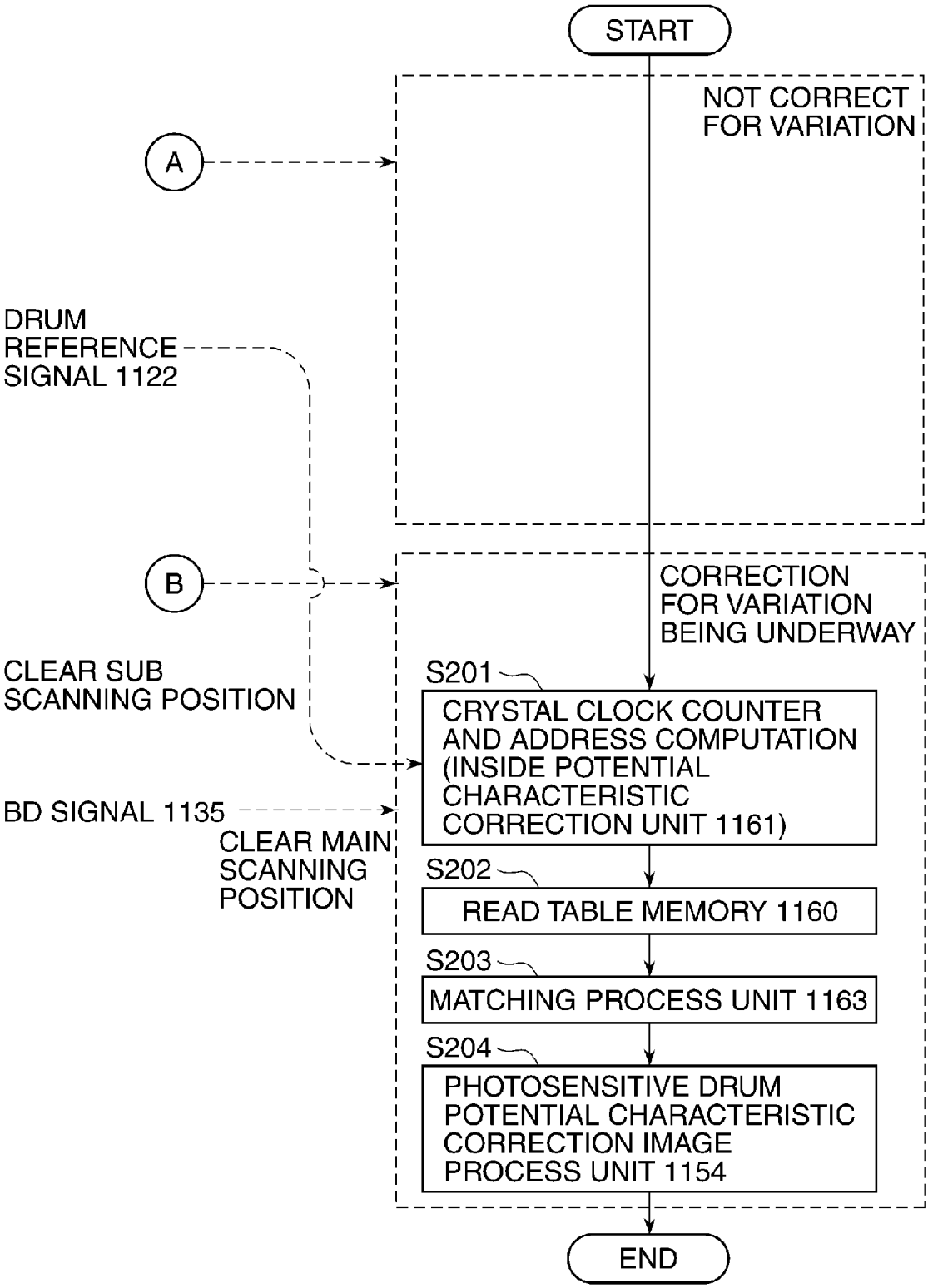

In the above described way, in the image forming apparatus according to the present embodiment, the correction for variations in the potential characteristics of the photosensitive drum is started. According to the prior art, after the elapse of a predetermined time period since the speed of the photosensitive drum 130 stabilizes, it is necessary to wait for the input of the rotation reference position signal 122 (see the processes in the steps S104 and S105 in FIG. 8A). In the present embodiment, however, the need to wait is eliminated due to the above described loading function, and the correction for variations in the potential characteristics of the photosensitive drum is started in an instant.

After instructing to correction for variations in potential characteristics in the step S6, the system control unit 140 carries out an image forming operation (step S7). During the image forming operation, the image data process unit 150 starts image data process in response to a register access instruction 143 for image formation from the system control unit 140. Moreover, image data 151 is inputted from an external personal computer (not shown) and sent to the line buffer control unit 152 and stored as data in the line buffers 153 corresponding in number to the number of multiple lasers. The stored data is read in parallel as data corresponding in number to the number of multiple lasers from the line buffers 153 in timing with BD signals 1135 and sent to the photosensitive drum potential characteristic correction image process unit 154.

Next, a description will be given of the flow of a photosensitive drum potential characteristic variation correction image process. First, the potential characteristic correction unit (memory controller) 161 reads correction data from the non-volatile memory (table memory) 160 storing table data on variations in photosensitive drum potential characteristics (step S26). As described above, the correction data is prepared in advance in the table memory 160 in accordance with a photosensitive drum provided in the image forming apparatus.

The potential characteristic correction unit 161 transmits the table data on variations in photosensitive drum potential characteristics to the matching process units 163 via memory data buses 162, and the matching process units 163 perform a process in which the table data is matched to variation correction data that is to be multiplied with image data (step S27). The potential characteristic correction unit 161 successively transmits the variation correction data subjected to the matching process to the multiplication unit 154 (step S28). After that, the potential characteristic correction unit 161 terminates the present operation.

In the present embodiment, to select and read table data corresponding to a laser exposure position on the photosensitive drum 130, the potential characteristic correction unit 161 identifies a position in the sub-scanning direction on the photosensitive drum 130 based on the above described initial count value and the count using the crystal oscillator clocks. Further, the potential characteristic correction unit 161 identifies a position in the main-scanning direction (main-scanning position) on the photosensitive drum 130 based on the BD signal and the count using the crystal oscillator clocks. The operation of the potential characteristic correction unit 161 corresponds to a main-scanning position detection unit.

Based on the two-dimensional position on the surface of the photosensitive drum 130 thus identified, an appropriate address for taking out variation correction data as two-dimensional data is selected from the table memory 160. Thereafter, the potential characteristic correction unit 161 lies in a state of correcting for variations, and thus the variation correcting process state 202 in FIG. 2 is the valid state e.

The photosensitive drum potential characteristic correction image process unit (multiplication unit) 154 performs a computation (multiplication) of the data from the line buffers 153 and the variation correction data. As a result of the computation, the data having been subjected to the potential characteristic variation correcting process is transmitted to the laser PWMU 155, and made available for use in blinking the four-beam multi-laser semiconductor chip 101 via the laser current drive unit 106.

The laser light is gathered by the collimator lens 102 and then reflected/scanned by the polygon mirror 103 to pass through the fθ lens 104. Further, the laser light follows a laser light path 105 from the polygon mirror 103 to the photosensitive drum 130 and is scanned on the photosensitive drum 130 along paths taken by scanning lines 133 of exposure spots 131 by the four-beam multi laser by rotation of the polygon mirror 103. On the photosensitive drum 130 thus charged, an electrostatic latent image is formed.

After the electrostatic latent image is formed, the image forming apparatus develops the electrostatic latent image with toner, transfers the image to a paper medium, fixes the image on the paper medium by heating and pressurizing, so that an image is formed.

When a time period required to form an image of a predetermined size has elapsed, the system control unit 140 determines whether or not the image forming operation has been completed (step S8). When the image forming operation has not been completed, the system control unit 140 returns to the process in the step S7. On the other hand, when the image forming operation has been completed, the system control unit 140 instructs to decelerate the photosensitive drum 130 (step S9). The system control unit 140 waits until the deceleration is completed, that is, until the stop of the photosensitive drum 130 is confirmed (step S10), and terminates the present operation when the stop of the photosensitive drum 130 is confirmed.

In the above described way, while the rotation speed of the photosensitive drum 130 is changing, the image forming apparatus according to the first embodiment counts the number of pulses of the gear photo-sensor output signal 144 from the gear photo-sensor 138 based on the rotation reference position signal 122 for the photosensitive drum 130, thereby identifying a rough sub-scanning position of the photosensitive drum 130. Then, after the rotation speed of the photosensitive drum 130 stabilizes, the image forming apparatus computes an appropriate address based on the measured time period from the identified sub-scanning position, and obtains potential characteristic variation correction data in the sub-scanning direction and the main scanning direction from the table memory 160 to correct for variations in potential characteristics.

By the above described operation, a latent image is drawn on which the correction for variations in the potential characteristics of the photosensitive drum has been carried out, and the correction for variations in laser writing has been carried out. As a result, variations in the potential characteristics of the photosensitive drum 130 can be corrected for, improving image quality and enhancing the responsiveness of the image forming operation.

Namely, even while the DC brushless motor is accelerating, the rotation position (sub-scanning position) of the photosensitive drum can be detected with the cumulative accuracy of the gear photo-sensor output signals (rotation pulses). Thus, immediately after the motor rotation speed stabilizes in the first mode, the correction for variations in photosensitive drum potential characteristics can be started, and hence FCOT or FPOT can be considerably improved. Thus, the time period required to start the first correction for variations while the photosensitive drum is stationary can be shortened.

Moreover, the image forming apparatus according to the present embodiment can be realized at low cost because even a construction allowing periodical jitter such as a construction comprised of gears for transmitting power from the DC brushless motor to the photosensitive drum and the photosensor can be used insofar as rotation pulses can be generated. Further, a high-quality latent image can be obtained over the entire surface of the photosensitive member.

It should be noted that variations in potential characteristics may be corrected for in a "full-time mode 1" using an inexpensive encoder signal all the time. In some cases, however, periodical jitter caused by variations in motor rotation is superposed on the signal, and pitch variations may occur in exposure data due to the effects of the variation correction unit. On the other hand, according to the present embodiment, because exposure data is not affected by signal jitter due to the function of switching to the second mode, there are no pitch variations. The pitch variations mean variations in streaks of an image caused by abnormal density variations.

As described above in the description of first embodiment, the present invention is useful in shortening the time period required to start the first correction for variations while the photosensitive drum is stationary. In a second embodiment, the present invention is useful as well in shortening the time period required to start the correction for variations again after the photosensitive drum temporarily goes into a state of not rotating at constant speed for image formation as in a case where the next image is desired to be formed during deceleration after the formation of a previous image is completed. It should be noted that in the second embodiment as well, the rotation position of the photosensitive drum is continuously measured in the first mode as necessary, and is used in the second mode.

Figure 4A:
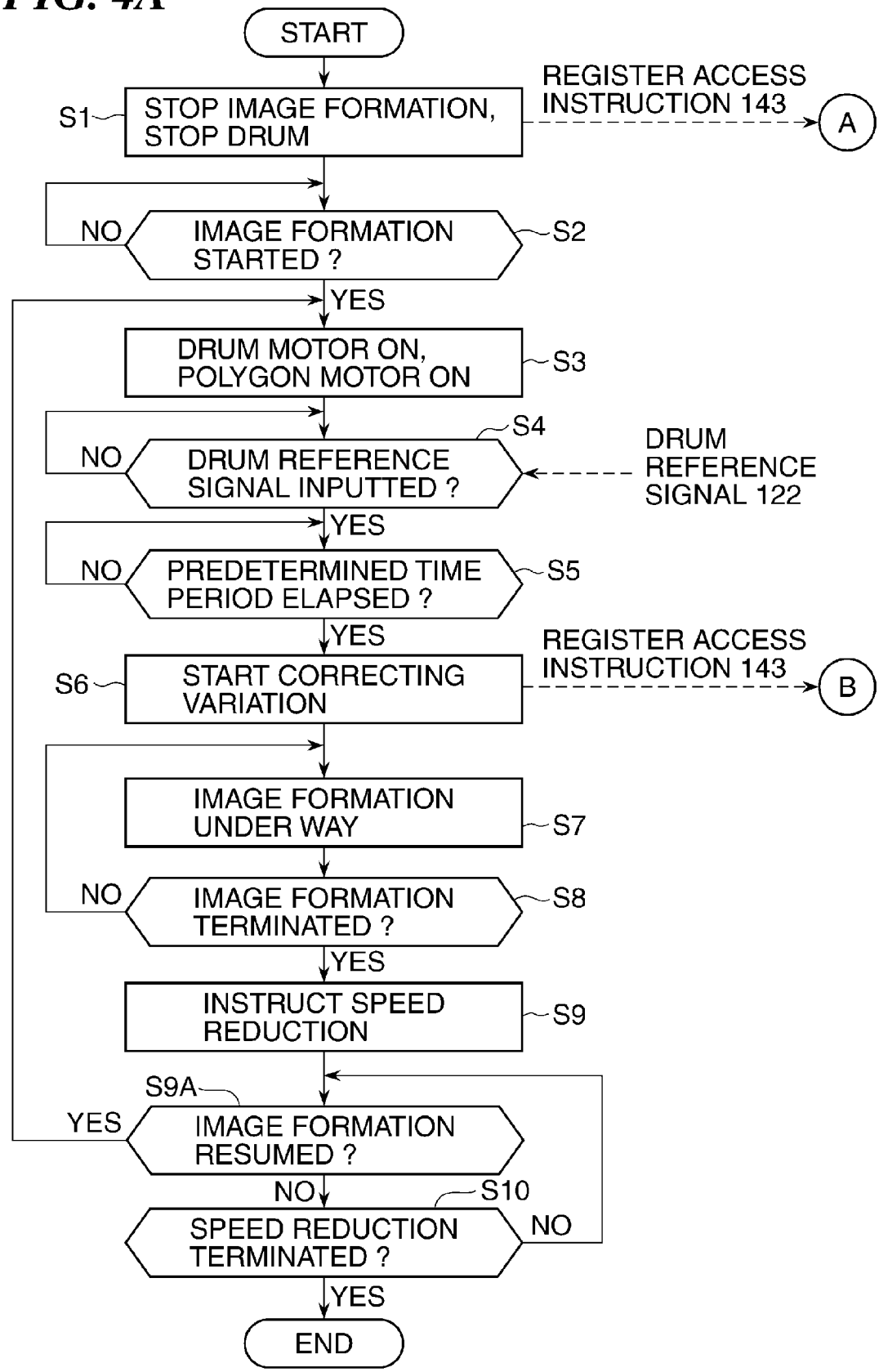
FIGS. 4A and 4B are flowcharts showing procedures of an image forming operation and procedures of a potential characteristic variation correcting operation according to a second embodiment of the present invention.
Figure 4B:
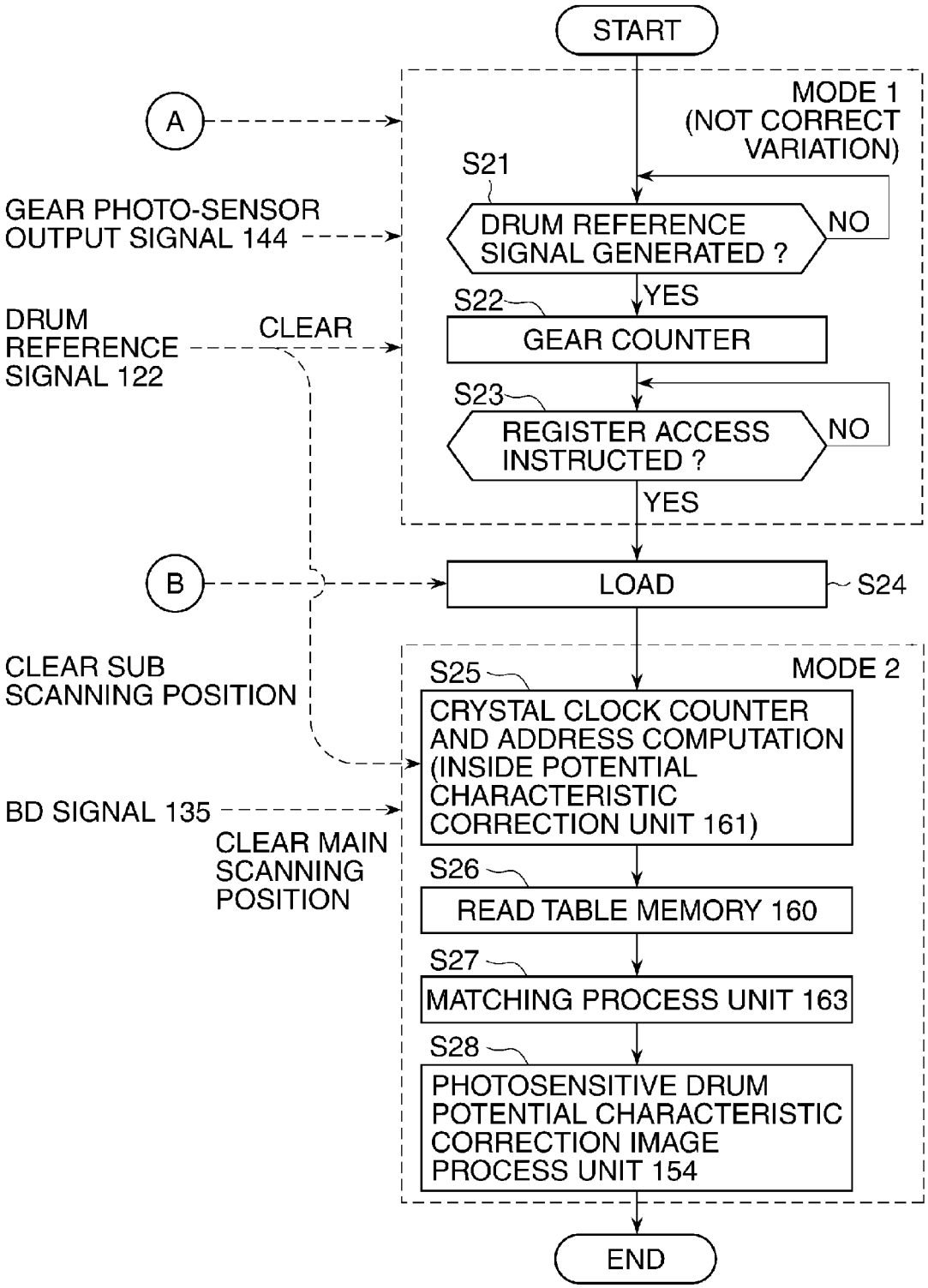

FIGS. 4A and 4B are flowcharts showing procedures of an image forming operation and procedures of a potential characteristic variation correcting operation according to the second embodiment. In the figure, FIG. 4A shows the operation of the CPU in the system control unit 140, and FIG. 4B shows the operation of the potential characteristic correction unit 161 in the image data process unit 150 (ASIC). In the figure, broken lines indicate the transmission of information via input/output signals to and from devices. It should be noted that the image forming apparatus according to the second embodiment has the same arrangements as those of the above-described image forming apparatus according to the first embodiment. The same components as those of the first embodiment are designated by the same reference symbols, and detailed description thereof is omitted. Moreover, among step processes of the second embodiment (see FIGS. 4A and 4B), the same step processes as those of the first embodiment (see FIGS. 3A and 3B) are designated by the same step numbers, and detailed description thereof is omitted. Only step processes different from those of the first embodiment will be described below.

The system control unit 140 determines whether or not an instruction to resume image formation has been given while waiting for the completion of deceleration in the step S10 after the instruction to decelerate the photosensitive drum 130 is given in the step S9 after the completion of image formation (step S9A). When an instruction to resume image formation has not been given, the system control unit 140 proceeds to step S10.

On the other hand, when an instruction to resume image formation has been given, the system control unit 140 returns to the step S3. In accordance with the instruction to resume image formation, the operation in the first mode is carried out again. Thus, the waiting time period before starting the correction for variations in potential characteristics is not needed as is the case with starting from standstill.

Therefore, immediately after waiting for the predetermined time period in the step S5, the system control unit 140 instructs to start the correction for variations in potential characteristics in the step S6. In response to a register access instruction 143 from the system control unit 140, the image data process unit 150 starts image data process.

As described above, the time period required to start the first correction for variations in potential characteristics during the deceleration of the photosensitive drum can be shortened as is the case with the first embodiment. Moreover, the image forming apparatus continues measuring the position of the photosensitive drum as necessary in the first mode, and uses the measured position in the second mode. As a result, it becomes possible to shorten the time period required to start the first correction for variations in potential characteristics again after the photosensitive drum temporarily goes into a state of not rotating at constant speed for image formation as in a case where the next image is desired to be formed during deceleration after the formation of a previous image is completed.

Although in the first embodiment, the gear photo-sensor 138 is provided so as to detect an absolute position of the photosensitive drum 130 in the first mode, the gear photo-sensor may not be provided because it is only necessary to know the approximate absolute position of the photosensitive drum. In a third embodiment, the absolute position of the photosensitive drum is detected using FG signals synchronizing with the rotation of the DC brushless motor.

Figure 5:
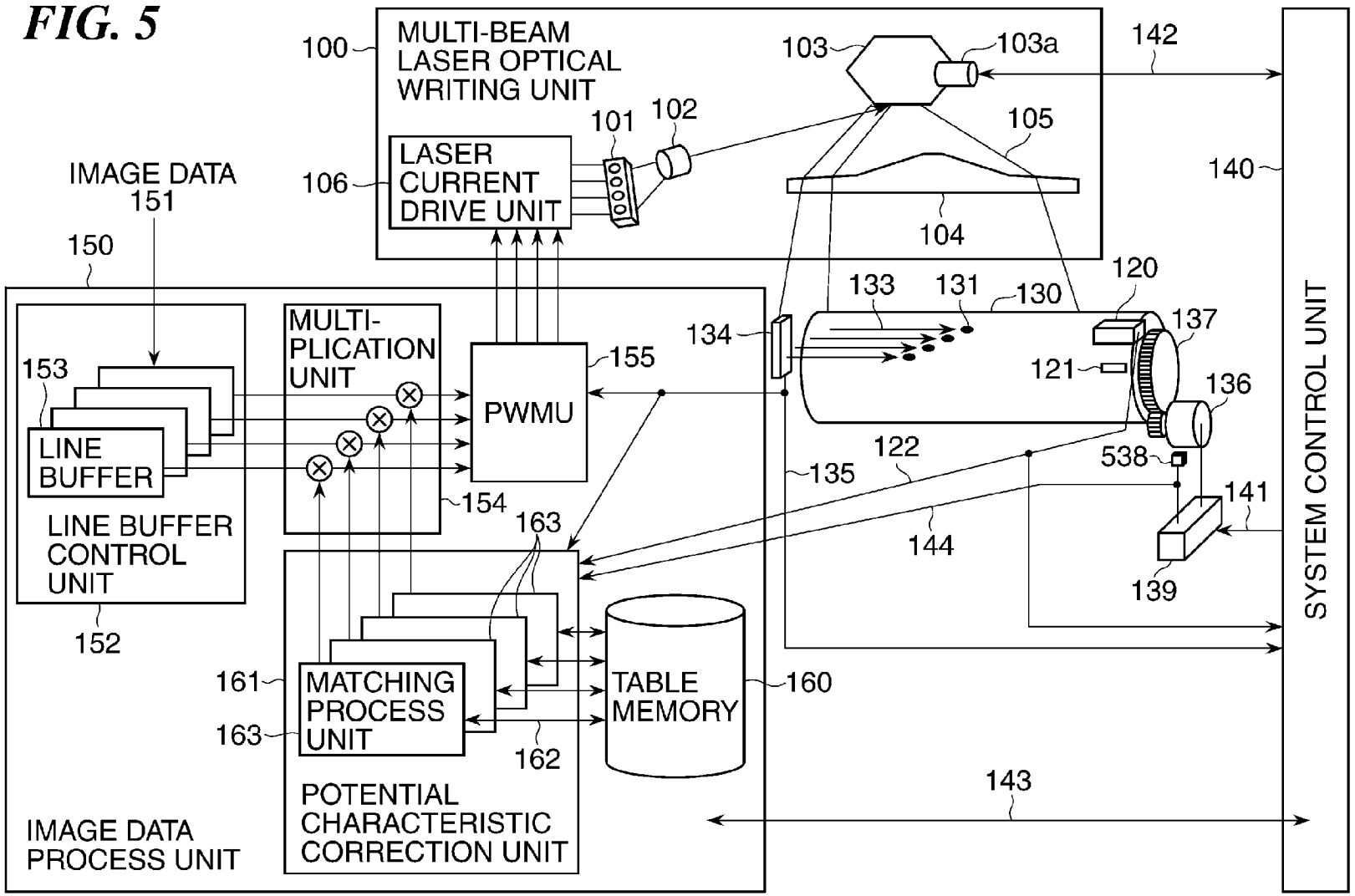
FIG. 5 is a diagram schematically showing an arrangement of an optical writing unit in an image forming apparatus according to a third embodiment of the present invention.
Figure 6:
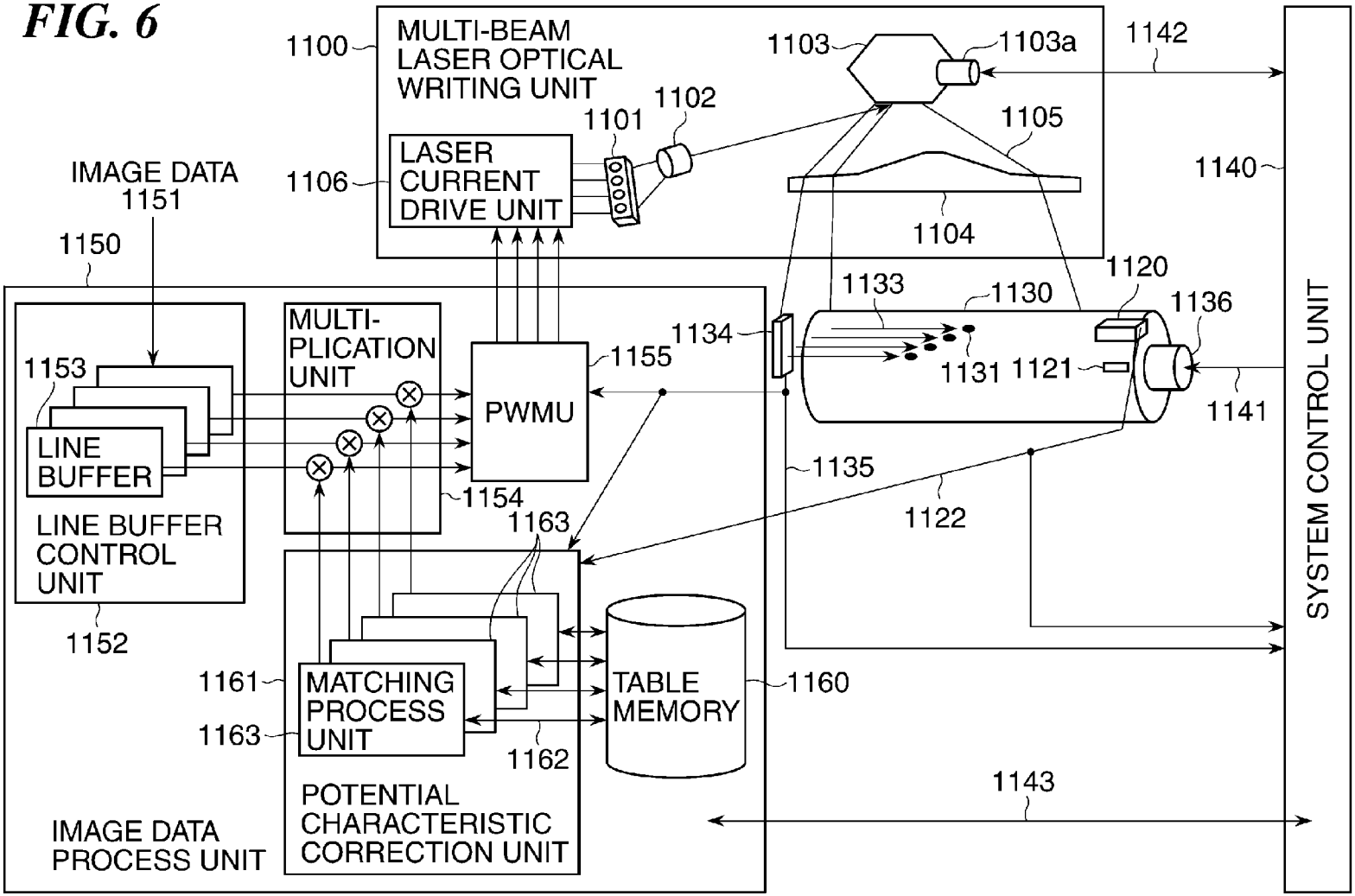
FIG. 6 is a diagram schematically showing an arrangement of an optical writing unit in a conventional image forming apparatus.
Figure 7:
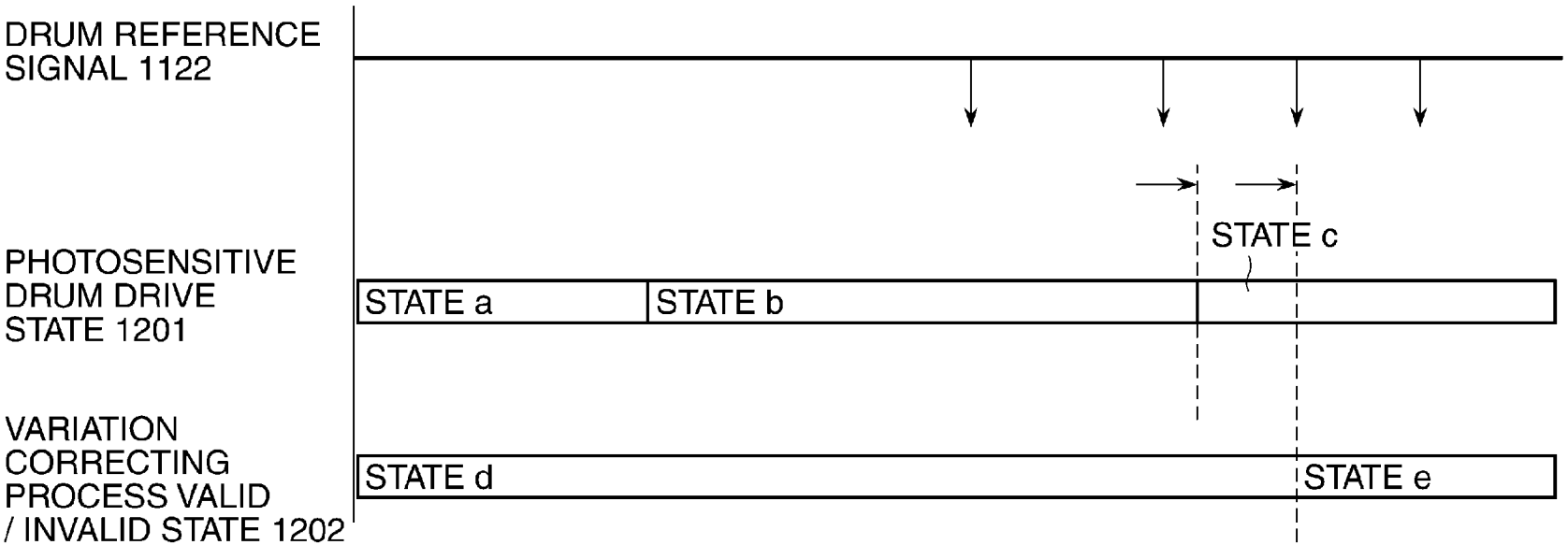
FIG. 7 is a timing chart showing operations of units when a photosensitive drum starts rotating in the image forming apparatus.

FIG. 5 is a diagram schematically showing an arrangement of an optical writing unit in an image forming apparatus according to the third embodiment. The image forming apparatus according to the third embodiment has substantially the same arrangements as those of the above-described image forming apparatus according to the first embodiment. The same components as those of the first embodiment are designated by the same reference symbols, and detailed description thereof is omitted, only features that are different from those of the first embodiment being described below.

The reduction gear 137 of the drive power transmission system is mounted between the photosensitive drum 130 and the DC brushless motor 136, and has a large gear pivotally supported by a photosensitive drum shaft and a small gear pivotally supported by a motor shaft.

A hall element and an amplification buffer 538 are provided around the motor shaft of the DC brushless motor 136, and outputs FG signals 544 synchronizing with the rotation of the DC brushless motor 136. The FG signals 544 are transmitted to a DC brushless motor driver unit 539, which drives the DC brushless motor 136, and also transmitted to the potential characteristic correction unit 161 in the image data process unit 150.

According to the image forming apparatus of the third embodiment, in a case where a sufficient number of FG signals can be obtained from the hall element attached to the motor, the potential characteristic correction unit 161 uses the FG signals as pulses of the rotatively driving pulse generation unit. In this case, it is preferred that a motor that enables FG signals of a plurality of periods to be generated within one generation period of a pulse signal generated when the rotation reference position sensor 120 detects the rotation position mark 121 provided on the photosensitive drum 130. Thus, because it is only necessary to know the approximate absolute position of the photosensitive drum 130, there is no need to add any sensor, and costs can be further reduced. It should be noted that without using the FG signals from the motor, an encoder may be mounted on the photosensitive drum, and signals outputted from the encoder with the rotation of the photosensitive drum may be used.

It should be noted that the present invention is not limited to the arrangements of the above described embodiments, but may be applied to any other arrangements insofar as the functions described in the claims or the functions of the arrangements of the above described embodiments can be achieved.

For example, the application scope of the present invention does not depend on a method of modulating a light quantity of a light-emitting device, and it is thus possible to use various modulation methods such as the PWM (Pulse Width Modulation) method used in the above described embodiments, and an electric current modulation method as described in Japanese Laid-Open Patent Publication (Kokai) No. 2007-34233.

Moreover, although the image forming apparatus according to the first embodiment lies in the variation correction mode in the first mode, the correction may be started at a position obtained from the gear counter after waiting for the input of the first rotation reference position signal 122. Also, the present invention may be practiced in a case where the correction is started with an initial corrected positional deviation allowed before the input of the first rotation reference position signal 122. In this case, the correction for variations in the potential characteristics of the photosensitive drum can be carried out early during image formation.

Further, the image forming apparatus according to the first embodiment executes the process in the step S4 in which the input of the first rotation reference position signal 122 is waited for before the mode is switched to the second mode. However, in a case where the photosensitive drum is designed to be necessarily turned one turn in a predetermined time period, it goes without saying that the present invention may be practiced even if the process in the step S4 in which the input is waited for is dispensed with. In this case, the correction for variations in potential characteristics can be carried out early in a good condition during image formation.

Further, it goes without saying that the present invention may be applied to not only the printer, but also a facsimile machine having a print function, and a multifunctional peripheral device (MFP) having a print function, a copy function, a scanner function, and so on.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-284258 filed Nov. 5, 2008 and Japanese Patent Application No. 2009-251795 filed Nov. 2, 2009, which are hereby incorporated by reference herein in its entirety.

What is claimed is:

1. An image forming apparatus comprising:

a photosensitive member;

a drive unit configured to rotate said photosensitive member by a drive motor;

an exposure unit configured to emit a light for exposing said photosensitive member;

a storage unit configured to store correction data for correcting a light quantity of said exposure unit in association with exposure positions on said photosensitive member;

a first generation unit configured to generate a first signal in response to a reference position provided on said photosensitive member passing a predetermined position while said photosensitive member is rotating;

a second generation unit configured to generate a second signal in accordance with rotation of said photosensitive member, a plurality of generation periods of the second signals being included in one generation period of the first signal; and a control unit configured to, while during an acceleration control in which said photosensitive member is controlled to accelerate by said drive unit, count the second signals in response to input of the first signal, identify based on a count value of the second signals an exposure position when said photosensitive member is switched from the acceleration control to a constant-speed control in which said photosensitive member is controlled to maintain a constant speed by said drive unit, read correction data corresponding to the identified exposure position from said storage unit, and control the light quantity of said exposure unit based on the correction data read from said storage unit.

2. An image forming apparatus according to claim 1, further comprising:

a clock generation unit configured to supply reference clocks to said control unit, wherein said control unit, during the constant-speed control, counts the reference clocks in response to generation of the first signal, identifies an exposure position of said photosensitive member based on a count value of the reference clocks, read correction data corresponding to the identified exposure position from said storage unit, and control the light quantity of said exposure unit based on the read correction data; and wherein said control unit, in response to input of the first signal after said photosensitive member is switched from the acceleration control to the constant-speed control, switches from counting of the second signals to counting of the reference clocks.

3. An image forming apparatus according to claim 2, wherein said control unit, during the constant-speed control, initializes counting of the reference clocks in response to the first signal generated by said first generation unit, and starts counting the reference clocks from the initialized state.

4. An image forming apparatus according to claim 1, wherein the second signal generated by said second generation unit is a signal obtained from a hall element attached to the drive motor.

5. An image forming apparatus according to claim 1, wherein said second generation unit comprises a sensor that detects a rotation position of a gear member that transmits power of the drive motor to said photosensitive member; and wherein the second signal generated by said second generation unit is an output signal from the sensor.

* * * * *